United States Patent [19]

Evans

[11] 4,431,335

[45] Feb. 14, 1984

[54] METHOD OF REPAIRING POTHOLES IN ROAD SURFACES BY FILLING THEM WITH FLY ASH HARDENED IN WATER

[76] Inventor: Thomas W. Evans, 133 E. 64th St., New York, N.Y. 10021

[21] Appl. No.: 231,396

[22] Filed: Feb. 4, 1981

[51] Int. Cl.[3] ..... E01C 7/10

[52] U.S. Cl. ..... 404/75; 404/108

[58] Field of Search ..... 404/72, 75, 76, 82, 404/81, 27, 28, 31, 17, 19, 20, 21, 30, 108; 106/119, 120, 118

[56] References Cited

U.S. PATENT DOCUMENTS

| | | | |
|---|---|---|---|
| 940,971 | 11/1909 | Howe | 404/81 |
| 2,564,690 | 8/1951 | Havelin | 106/120 |
| 2,934,452 | 4/1960 | Sternberg | 404/75 X |
| 3,206,319 | 9/1965 | Minnick | 106/119 |
| 3,753,620 | 8/1973 | Minnick | 404/76 |
| 3,817,643 | 6/1974 | Azar | 404/76 |

*Primary Examiner*—Nile C. Byers, Jr.

[57] ABSTRACT

This application relates to a method for quickly and efficiently filling a pothole in a road surface, utilizing a mixture of fly ash and water which hardens into a compact mass capable of supporting vehicular traffic.

11 Claims, No Drawings

METHOD OF REPAIRING POTHOLES IN ROAD SURFACES BY FILLING THEM WITH FLY ASH HARDENED IN WATER

FIELD OF THE INVENTION

This invention relates to a method of repairing potholes in road surfaces.

BACKGROUND OF THE INVENTION

Potholes are well known to those who travel paved roadways. Moreover, the unavoidable appearance of potholes in paved road surfaces is a continuous problem to those responsible for the maintenance of the nation's roadways. Potholes most commonly appear during the winter months and are caused by rapid changes in the temperature of the pavement which lead to the cracking of the road surfaces. The crack in the road surface then lends itself to the entry of water, which upon freezing results in the loss of hunks of pavement leaving potholes.

Potholes present a definite hazard. They frequently cause vehicles to swerve from their intended path when attempting to avoid them, and when a vehicle strikes a pothole, it may be deflected, causing the driver to lose control of his vehicle. Tire and automobile frame damage may be the costly result to car and truck owners when potholes are struck. Finally, the cost incurred by municipal, state or federal agencies in repairing potholes and maintaining a smooth road surface is significant. Considerable economic drain is imposed on the agencies responsible as a result of the costs they must pay in repairing potholes wherever paved roads are maintained. In fact, with the tightening of federal, state and local budgets, the coats for the prompt and permanent repair of potholes are becoming increasingly prohibitive.

The current methods for the permanent repair of potholes are expensive, time consuming and frequently result in traffic delays. In an attempt to minimize traffic delays and cost, most pothole repairs are temporary and involve no more than pouring a heated bituminous material into the pothole and compacting it down to a smooth surface.

One generally accepted method for the temporary filling of potholes comprises filling the pothole with an asphalt-concrete mix. The hole must be dried before the addition of the filler, and the asphalt-concrete mix subsequent to being applied to the pothole must be thoroughly compacted with either a pneumatic compactor, a vibratory plate compactor or a roller. This procedure is relatively expensive since it utilizes an expensive asphalt-concrete mixture which in turn requires expensive equipment to apply it. Moreover, there is a considerable amount of human labor associated with the repair of potholes by this method which further increases the cost of repair. In making a repair utilizing an asphalt-concrete filler a three-man crew is required—namely, a compactor operator, truck driver and a laborer to add the filler to the hole.

The prior art does not disclose a method of repairing potholes in road surfaces utilizing a relatively inexpensive material, which requires little or no preparation prior to use and requires a minimum of time and human labor to effectuate a road repair utilizing it.

The method of this invention employs a self-hardening mixture of fly ash and water to fill crevices or potholes in road surfaces. Fly ash is plentiful and cheap. In fact, fly ash is often viewed as an undesirable waste product resulting from the combustion of coal or other solid fossil fuels by electric utility plants.

In the past, attempts have been made to find commercial applications for fly ash. For example, fly ash has been used in the construction of highway embankments, roads, or as a component in concrete or asphalt formulations. In addition, fly ash has been utilized in the form of a grout to fill an abandoned sewer. See "Ash at Work—Process and Technical Data" NAA Summary Report (May-October 1975); *Professional Engineer*, pp. 18–22, July 1974; "How Fly Ash Improves Concrete Blocks, Ready-Mix Concrete, Concrete Pipe," *Concrete Industries Year Book*, pp. 1–6 (1970–1977). However, fly ash has not been utilized to fill potholes which result from the deterioration of conventional road surfaces comprised of, for example, asphalt, concrete, macadam or the like.

It is an object of this invention to provide a simple, quick and inexpensive method of filling potholes to restore a safe and long-lasting road surface.

It is a further object of this invention to provide a method of filling crevices in road surfaces employing a relatively inexpensive by-product material which, unlike conventional road fill materials, requires little or no preparation prior to use, and a minimum of human labor to effectuate road repairs utilizing it.

BRIEF DESCRIPTION OF THE INVENTION

In accordance with the foregoing objectives, the present invention provides a method for quickly and inexpensively filling a pothole. The method of this invention requires a minimum of human labor, and utilizes fly ash, a material which is generally viewed as a waste product, as the essential ingredient employed to repair the pothole. The pothole repair method of this invention comprises the steps of: (a) adding fly ash to a pothole which is filled with water, said fly ash being added in an amount sufficient to fill said pothole to a level which about equals the outermost surface of said road, and (b) said fly ash and water comprising a self-hardening mixture which upon drying hardens into a compact mass filling said pothole.

In another embodiment the present invention comprises a method for repairing potholes utilizing the fly ash by-product from a coal burning utility plant. The method comprises the steps of: (a) collecting fly ash produced by a coal burning utility plant in a container, wherein said fly ash is drawn into said container by vacuum means associated with said container, and wherein said container also has means for exhausting said fly ash from said container, (b) transporting said container to a pothole which is filled with water and exhausting said fly ash from said container and into said pothole, (c) said fly ash being added in an amount sufficient to fill said pothole to a level which about equals to the outermost surface of said road, and (d) said fly ash and water comprising a self-hardening mixture which upon drying hardens into a compact mass filling said pothole.

DETAILED DESCRIPTION OF THE INVENTION

Fly ash is a by-product material which is produced as a result of the combustion of a solid fuel. In particular, fly ash is the fine non-combustible particles of ash carried out of the solid fuel bed when it is combusted. The solid non-combustible material which remains in the fuel bed is referred to as bottom ash. One of the most common sources of fly ash is utility plants which burn powdered coal to produce electrical energy. After the coal has been combusted, there generally remains a 6% by weight ash residue of which 2% is bottom ash and 4% is fly ash. As an example, a 650 mgw plant at full load burns 600 tons of coal per hour, producing 24 tons of fly ash per hour.

Chemically, fly ash is a finely divided mineral product high in silica, aluminum and iron and significantly deficient in lime. Fly ash resulting from the combustion of one batch of coal or other solid fuel may differ in chemical composition from the fly ash produced from the combustion of a different batch of solid fuel. Thus detailed chemical analysis has shown that the fly ash by-product from one power station may differ in chemical composition from the fly ash produced at a different power plant. See P. T. Sherwood, M. D. Ryley, "The Use of Stabilized Pulverized Fuel Ash in Road Construction," Crowthorne Road Research Laboratory, *RRL Report No.* 49 (1966). However, chemical analysis shows the presence of the following metal oxides in the fly ash samples tested: $SiO_2$, $Al_2O_3$, $Fe_2O_3$, CaO, MgO, $K_2O$, $Na_2O$ and $SO_3$.

A mixture of fly ash and water is known to harden into a solidified rock-hard mass. The ratio of water to fly ash in the mix is not critical since regardless of the quantity of water present, upon eavporization the component fly ash mass is produced. However, not all fly ash and water mixtures have the ability to self-harden into a solidified mass. The fly ash and water mixtures employed by this invention, however, are self-hardening mixtures which solidify upon drying.

The selection of a suitable fly ash is readily accomplished by testing the fly ash-water mixture for its ability to self-harden upon drying into a compact mass. This may be simply done by placing an approximately 1:1 mixture of fly ash and water in a glass vessel and allowing the mix to air dry. Fly ash suitable for use in this invention will harden into a solid mass. On the other hand, fly ash-water mixtures which do not self-harden upon evaporation of the water component are unsuitable for use in accordance with this invention.

As a further aid in selecting a fly ash sample to use, the hardened mass formed from the mix may be subjected to testing to determine its compressive strength in pounds per square inch. Preferably, the solidified fly ash employed has a compressive strength in the range of from about 2,050 to about 2,530 pounds per square inch.

Potholes frequently have a jagged interior structure of crevices and the like which may extend deep into the road bed, and even underneath the surface of the remaining portions of the road surface area about the pothole. As these underground crevices expand due to deterioration by water, ice, and the like, additional portions of the road surface about the pothole may cave in, and as a result the size of the pothole increases. Therefore, in order to properly fill a pothole, all crevices which extend from the pothole and under existing road surface areas should be filled.

Under the microscope most of the particles of fly ash are seen to be spherical in shape and glassy in appearance. When fly ash is introduced into a pothole which is filled with water, the fly ash material acts like minute ball bearings and flows into every interior crevice of the pothole. Thus, by the introduction of the fly ash into the pothole not only is the road crevice filled, but the danger of further road deterioration is also substantially reduced or eliminated. The ability of fly ash to flow like ball bearings into all of the internal crevices of a pothole contrasts sharply with other road fill materials such as the commonly used bituminous materials which are less malleable and which may leave sub-surface cavities within the pothole.

In accordance with one embodiment of the present invention fly ash is added to a pothole which is filled with water. As dry fly ash enters standing water, the particles flow very quickly downwardly eventually completely filling the pothole. A sufficient amount of fly ash is added to fill the pothole to the top of the hole and about even with the uppermost surface of the road. There is no need for the precise measurement of the mix. The excess water simply runs off as the fly ash reaches the top of the hole. As the wet fly ash reaches the level of the road surface, it may be desirable to mechanically smooth over the top layer of the fly ash fill with a trowel or shovel to insure a smooth road surface in the area of the repair.

While the hardening time may vary from fly ash sample to fly ash sample, fly ash has been observed to harden to a mass capable of supporting vehicular traffic within about fifteen minutes. Although a sufficient load bearing strength may be reached within about fifteen minutes, depending upon the size of the fly ash mass, the drying through of the water-fly ash mixture may continue for hours. Throughout the drying period traffic may proceed over the fly ash fill. Moreover, during the drying process, the surface of the fly ash will be compressed to a smooth top surface by the passage of vehicular traffic over it.

The water employed in combination with the fly ash may be the water which is frequently found, and naturally present in potholes. Alternatively water may be added to a dry pothole, or to supplement the water already in the pothole prior to the introduction of the dry fly ash. In any case the fly ash is preferably added to a pothole which is completely filled with water. The presence of excess water on top of the fly ash mass does not affect the hardening process.

An advantage associated with this method is the speed and simplicity with which a pothole repair can be accomplished. Equipment and personnel are required only for inserting the water (where necessary) and dry fly ash into the pothole, thereby eliminating the necessity for heating equipment, compaction equipment, etc., and the personnel to operate such equipment.

The method of this invention may be implemented using commonly available equipment. For example, a conventional truck or other vehicle may be employed to transport a drum or bag of dry fly ash as well as a shovel or other implement for introducing the fly ash into the pothole. The fly ash, of course, should be transported in a container which maintains it in a dry state. In addition, a water container having a hose or other means for introducing water, where necessary, into the pothole may be a necessary piece of equipment to complete the road repair. With this simple equipment, a single repairman can repair a pothole by adding water and fly ash to the pothole. As a final step in the repair process, the repairman may employ a shovel or trowel to smooth over the surface of the filled pothole. The entire repair can be completed within minutes.

In order to accomplish the rapid repair of a large number of potholes on a deteriorating road surface, a more automated method of repair may be employed. For this purpose a truck carrying a reversible vacuum container may be employed. Trucks having reversible vaccum containers are commercially available from W. W. Andress Co., Bergenfield, N.J.; and a trailer which carries a reversible vacuum container is commercially available from the D. P. Way Corp., Milwaukee, Wis.

More specifically, the truck first travels to the fly ash storage site, such as a coal burning utility plant, to receive a charge of dry fly ash which is stored in a containerized drum carried by the truck. The containerized drum should be equipped with a hose, and a reversible vaccum. At the fly ash storage site the vacuum is actuated to draw a charge of fly ash into the containerized drum carried by the truck. The truck then travels to the pothole site. If the pothole is already filled with water, the operator simply exhausts an amount of fly ash into the pothole sufficient to completely fill the pothole with fly ash. The operator may then smooth over the surface of the fly-ash-filled hole with a shovel or trowel, and quickly move onto the next pothole.

On the other hand if the pothole is not filled with water, the operator may employ a water supply carried by the repair vehicle to fill the pothole with water prior to the addition of the fly ash.

As an alternative to adding fly ash to a pothole to which water has been previously added, the fly ash and water may be added simultaneously to the pothole, or the fly ash may be added first and then the water. For example, in the repair vehicle described above, the water hose and the hose line which exhausts the fly ash may be joined by a Y-shaped joint such that a mixture of fly ash and water is simultaneously discharged by the vehicle.

Finally, the fly ash water mixture may be employed to partially or substantially fill the pothole, and a second road fill material may be employed to complete the repair. For example, the pothole may be filled to within about 2½ inches of the uppermost road surface, and the repair may be completed by applying a top road surface of a conventional repair material such as asphalt, a concrete-asphalt mix, or the like.

EXAMPLE

Fly ash was obtained from a coal burning utility plant and one-inch cubes of the solidified fly ash and water mix were prepared. The compressive strength of the five samples was tested by a standard laboratory procedure employing a Baldwin-Emery Universal Testing Machine. The following results were obtained:

| | Compressive Strength | | Compressive |
|---|---|---|---|
| Sample | Area of Sample sq. in. | Breaking Load lbs. | Strength (psi) |
| 1 | 1.071 | 2,600 | 2,430 |
| 2 | 1.107 | 2,800 | 2,530 |
| 3 | 1.081 | 2,220 | 2,050 |
| 4 | 1.009 | 2,400 | 2,380 |
| 5 | 1.113 | 2,280 | 2,050 |
| Average | | | 2,290 |

The fly ash sample tested above to have an average compressive strength of 2,290 psi was employed to repair a pothole. As a first step, water was added to the pothole so as to completely fill the pothole with water. Dry fly ash was then added to the water in the pothole. The water flowed through the fly ash and filled every crevice in the pothole. Excess water and fly ash which overflowed the pothole was smoothed over with a shovel. Within fifteen minutes a smooth road surface in the area of the pothole was provided.

This invention has been described in terms of specific embodiments set forth in detail herein. It should be understood, however, that these are by way of illustration only and that the invention is not necessarily limited thereto. Modifications and variations will be apparent from this disclosure and may be resorted to without departing from the spirit of this invention, as those skilled in the art will readily understand. Accordingly, such variations and modifications of the disclosed embodiments are considered to be within the scope of this invention and the following claims.

We claim:

1. A method for repairing a pothole in a road surface comprising the steps of:

(a) collecting fly ash in a container, wherein the fly ash is drawn into the container by vacuum means associated with the container, and wherein the container also has means for exhausting the fly ash from the container; and (b) exhausting fly ash from the container and into a pothole which contains water and has a jagged interior structure of crevices which extend into the road bed beneath the road's surface, wherein the fly ash upon being exhausted into the pothole flows through the water present in the pothole and into the internal crevices of the pothole, the fly ash and water comprising a mixture which hardens into a compact mass filling the pothole.

2. The method according to claim 1 wherein said compact fly ash mass has a compressive strength within the range of from about 2,050 to about 2,530 pounds per square inch.

3. The method according to claim 2 wherein said pothole is in an asphalt, concrete or macadam road surface.

4. The method according to claim 1 further comprising the step of adding an amount of water to said pothole which is sufficient to completely fill said pothole with water, prior to the addition of said fly ash to said water-containing pothole.

5. The method according to claim 1 wherein the fly ash and water hardens into a mass having load bearing strength sufficient to support vehicular traffic within about 15 minutes.

6. The method according to claim 4 wherein said compact fly ash mass has a compressive strength within the range of from about 2,050 to about 2,530 pounds per square inch.

7. The method according to claim 4 wherein said pothole is in an asphalt, macadam or concrete road surface.

8. The method according to claim 1 wherein said fly ash is produced by a coal burning utility plant.

9. A method for repairing a pothole in a road surface comprising:

(a) collecting fly ash in a container, wherein the fly ash is drawn into the container by vacuum means associated with the container, and wherein the container also has means associated therewith for exhausting the fly ash from the container; and (b) exhausting fly ash from the container and into a pothole, the pothole being partially filled with water and having a jagged interior structure of crevices which extend beneath the road's surface, and wherein the fly ash upon being exhausted into the pothole flows through the water present in the pothole and into the internal crevices of the pothole, the fly ash and water comprising a mixture which hardens into a compact mass partially filling the pothole; and (c) applying a road surfacing material to the partially filled pothole to complete the filling of the pothole to a level which equals the outermost surface of the road.

10. The method according to claim 9 wherein the fly ash and water hardens into a mass having load bearing strength sufficient to support vehicular traffic within about 15 minutes.

11. The method according to claim 9 wherein said fly ash is produced by a coal burning utility plant.

* * * * *